US005705034A

United States Patent [19]

Schiel

[11] Patent Number: 5,705,034

[45] Date of Patent: Jan. 6, 1998

[54] METHOD AND APPARATUS FOR REMOVING WATER FROM A WEB BY MEANS OF PRESSES

[75] Inventor: Christian Schiel, Heidenheim, Germany

[73] Assignee: Voith Sulzer Papiermaschinen GmbH, Germany

[21] Appl. No.: 623,119

[22] Filed: Mar. 28, 1996

Related U.S. Application Data

[62] Division of Ser. No. 184,849, Jan. 21, 1994, Pat. No. 5,520,782.

[30] Foreign Application Priority Data

Jan. 23, 1993 [DE] Germany ..... 43 01 750.9

[51] Int. Cl.[6] ..... D21F 3/02

[52] U.S. Cl. ..... 162/205; 162/306; 162/358.3; 162/360.3

[58] Field of Search ..... 162/205, 358.3, 162/360.2, 360.3, 306

[56] References Cited

U.S. PATENT DOCUMENTS

| | | | |
|---|---|---|---|
| 2,709,398 | 5/1955 | Beachler | 162/306 |
| 3,861,996 | 1/1975 | Dorfel | 162/360.3 |
| 4,483,745 | 11/1984 | Wicks et al. | 162/358.3 |
| 4,556,451 | 12/1985 | Ely | 162/360.3 |
| 4,662,992 | 5/1987 | Mirsberger | 162/301 |
| 4,915,790 | 4/1990 | Dahl | 162/358.3 |
| 4,923,570 | 5/1990 | Steiner et al. | 162/360.3 |
| 4,988,410 | 1/1991 | Meinecke et al. | 162/360.3 |
| 5,178,732 | 1/1993 | Steiner et al. | 162/360.3 |
| 5,423,947 | 6/1995 | Steiner et al. | 162/194 |

FOREIGN PATENT DOCUMENTS

| | | |
|---|---|---|
| 273783 | 1/1913 | Germany . |

*Primary Examiner*—Karne M. Hastings

*Attorney, Agent, or Firm*—Ostrolenk, Faber, Gerb & Soffen, LLP

[57] ABSTRACT

A wet-press arrangement. The flexible press jacket of a shoe press roll removes the web to be dewatered in a first press nip directly from the wire on which the web has been formed. The web then passes, together with the press jacket, through a second press nip which is developed as a felted, lengthened press nip. The web then passes through a third press nip where it is transferred from the smooth outer surface of the press jacket onto the smooth outer surface of a press roll. The web then travels, together with the latter roll, through a fourth press nip, which again is developed as a felted, lengthened press nip. Following that, the web still follows the press roll up to a place of web removal.

29 Claims, 11 Drawing Sheets

METHOD AND APPARATUS FOR REMOVING WATER FROM A WEB BY MEANS OF PRESSES

This is a division of application Ser. No. 08/184,849 filed Jan. 21, 1994 now U.S. Pat. No. 5,520,782.

BACKGROUND OF THE INVENTION

The present invention relates to a method and apparatus for removing water from a fiber web that has been formed by one or more endless wire belts, particularly in a paper manufacturing machine, wherein the web is guided in a (generally) horizontal direction of travel of the machine. Water is removed by conducting the web through several press nips in succession, and an endless, water absorbing porous belt, preferably a so-called "felt belt" or "wet felt", travels with the web through at least one of the press nips. The web is conducted from press nip to press nip such that it never need travel free and is always supported by a wire belt, a felt belt or the outer surface of a roll.

Literature showing the prior art:

D1: U.S. Pat. No. 4,285,766

D2: Federal Republic of Germany 273783, FIG. 2

D3: Federal Republic of Germany 3425077, which is equivalent to U.S. Pat. No. 4,662,992

D4: Federal Republic of Germany 3808293, which is equivalent to U.S. Pat. No. 4,923,570

D5: U.S. Pat. No. 4,556,451

D6: Federal Republic of Germany 4026021 (FIG. 3), which is equivalent to U.S. Pat. No. 5,178,732

In many modern paper manufacturing machines, water is removed from the web by the method described in the first reference D1 or by similar methods. In such a method, the web is first conducted between the wire belt on which the web is formed and a first felt belt which is supported by a take-up suction roll, through a first press nip. Thereafter, the web travels further together with the first felt belt. The first felt belt, which is supported by a suction press roll, then conducts the web through two additional press nips, and the web is conducted by the smooth outer surface of a press roll through at least one additional press nip. This known method has proven satisfactory. However, it disadvantageously requires a large amount of space and there are high expenses for the purchase and operation of such a press section, particularly with regard to the suction rolls.

The second proposal described in reference D2 dates back to the initial days of the manufacture of paper by machine. The paper web is transferred in the first press nip from the wire belt to the smooth outer surface of a first press roll and is then conducted by the first press roll through additional press nips, namely through two felted and one non-felted press nips. After the latter nip, the web is conducted by a further smooth press roll into a final felted press nip. In this arrangement, the web passes through the last press nip in a direction opposite the direction of travel of the machine. Therefore it must be first conducted further, downstream of the press nip, by the last felt belt. Rewetting of the web by the felt belt results, causing inadequate dryness of the web in practice. The very large diameter of the first press roll as compared with the diameter of the other press rolls is also unfavorable. For these and other reasons, the above described known apparatus is not suitable for use in modern paper manufacturing machines.

In the third reference D3, the web is again removed from a wire belt by a smooth press roll and is conducted through a felted press nip. The latter felted press nip is lengthened in the direction of travel of the web by being a so-called shoe-press roll which includes a flexible, revolving press jacket that passes over a press shoe. The press jacket comes into contact with the felt belt in the press nip. Another difference in principle between above references D2 and D3 is that in D2, as is generally customary, the wire belt contacts the lower side of the web, upstream of and within the first press nip, while in D3, the wire belt contacts the top side of the web. In D3, the web is formed in a twin-wire zone and after that zone, the web continues to move in an upward direction together with the upper wire. Upstream of the first press nip, a steam blow box and suction boxes are provided therein for the removal of water from the web. This has the disadvantage that the press rolls must be arranged at a relatively great height above the twin-wire zone and above the following drying section. This known apparatus is therefore not advisable, in part because of the necessity of expensive and tall support frames, with the danger of mechanical vibrations, in further part because of the hot air rising from the inlet into the drying section, and also because the operation and accessibility during operation are made difficult by all of these circumstances, in particular during the work that is periodically necessary for replacing rolls and wire and felt belts. Another disadvantage of the method described in reference D3 is that the removal of water from the web is effected only toward one side of the web. This provides a danger that the final web of paper will have dissimilar properties on its two sides, causing a two sided nature of the paper web. The guidance of the paper web through the following drying section, namely according to FIGS. 1 and 3, wherein the upper side of the web comes into contact with bottom drying cylinders, is also unfavorable. This makes removal of any possible broke very difficult.

In above reference D4, various wet press arrangements are described having a shoe press roll with a flexible rotating press jacket having a smooth outer jacket surface which comes into direct contact with the paper web. On a stationary support member, a radially movable press shoe is supported. The shoe has a concave slide surface. Alternately, several press shoes of this type are provided. In addition, rigid ledges with convex slide surfaces are provided.

The wet press arrangement described in above reference D5 comprises inter alia three press nips arranged one after the other along the web path, namely a felted press nip, an unfelted press nip, and a final felted press nip. However, no shoe-press unit is present, i.e. all of the press rolls are ordinary tubular rolls. Therefore, there is insufficient water removal capacity in this press.

In FIG. 3 of above reference D6, two shoe press rolls together form the feltless press nip. It is difficult to assure a dependable transfer of the paper web from one press jacket to the next for certain types of paper.

SUMMARY OF THE INVENTION

It is an object of the present invention to provide a method and an apparatus which satisfies as many of the following requirements as possible in connection with the removal of water from the web.

a) The greatest possible dryness of the web is to be obtained by the pressing for, among other reasons, the fact that at least one known shoe press roll can be used.

b) As far as possible, the final paper web has substantially identical properties on its two sides. In particular, the difference between the roughness values of the two sides of the web should be as small as possible, i.e. there should be little topographical two sidedness. In many cases, it is also important that porosity and absorptivity be as similar as possible on both sides of the web of paper i.e. little structural two sidedness.

c) The web should be guided such that it is always supported by a web guidance element between the press nips in order to avoid tearing of the web as much as possible. Furthermore, the web should be guided in the next following drying section such that the bottom of the web comes into contact with the surface of the cylinder jacket at least at the first drying cylinder.

d) The space required for the apparatus, here the press section, should be as small as possible, both in the horizontal or machine direction and also in the vertical direction for smallest possible structural height. In this way, the best possible ease of operation is obtained from the machine floor.

e) The expense for acquiring and operating should be as small as possible. Insofar as possible, expensive rolls should be avoided, for instance suction rolls with their relatively high consumption of energy for drive and production of vacuum.

In order to achieve these objects, several combinations of method steps and apparatus features are provided according to the invention.

In a paper making machine, there is a press arrangement between the forming or wire section upstream of the press arrangement and the drying section downstream thereof. The web is delivered to the press arrangement from the forming region by an endless wire belt. The first press roll in the press arrangement picks the web off the wire belt at a first press nip. The outer surface of the first press roll is a smooth surface. The web is carried on the surface of the first press roll to a second press nip between a second press roll and the first press roll. That second press nip is a felted nip so that water is removed from the web and absorbed by the felt. Preferably, one of the first and second rolls at the second nip is a shoe press roll for providing an extended nip length for the second press nip. From the second press nip, the web continues traveling on the outer surface of the first press roll until it reaches a third press nip formed between a third press roll and the first press roll. At the third press nip, the web transfers from the outer surface of the first press roll to the outer surface of the third press roll. The outer surface of the third press roll is also a smooth surface, and some means aids the transfer of the web from the first to the third press roll, e.g. the surface of the third press roll is harder than that of the first press roll or moisture is applied to the third press roll to increase the adherence of the web to the third press roll. There may be a fourth press nip defined by a fourth press roll and the third press roll. The fourth press nip preferably would also be felted for dewatering the web. There may be a fifth press nip which follows the fourth press nip in the path of the web and is defined by a fifth press roll and the third press roll.

All of these leave it open whether the belt, for instance the wire belt, contacts the bottom or the top of the web when the web is brought to the first press nip.

Common to all embodiments of the invention is that the web is taken up from the belt, either a wire belt or a felt belt of the preceding machine section, directly by the smooth outer surface of a first press roll. When the web is directly taken up from the wire belt, a take-up suction roll and vacuum blower may then be dispensed with. Nevertheless, the take-up place forms a first press nip which can be used in several variants of the invention for removing water from the web. A felted second press nip, developed in most embodiments as an extended length press nip, follows the first press nip. The second press nip thus has a high water removal capacity. Therefore, no expensive suction pressure roll is required. Furthermore, a third press nip formed by two smooth outer surfaces is provided for smoothing the web. Alternatively, the guidance of the web in accordance with the invention in all cases assures that the space necessary for such a third press nip is present. In this way, the required uniformity of quality of the surface on both sides of the web is obtained.

In a first aspect, a combination of features of the invention have additional advantages as compared with reference D2. There is less structural expense, because the required water removal capacity is as a rule obtained with a smaller number of press nips. Remoistening of the web following the last (felted) press nip is avoided due to a more favorable guidance of the web, i.e. due to the fact that the web passes essentially in the machine direction through the last press nip. This permits the felt to be separated from the web directly after the press nip.

In a second aspect, the invention provides that the web comes into direct contact with the flexible press jacket of at least one shoe press roll. This has the advantage of providing particularly high water removal capacity at the corresponding felted press nip, particularly as an ordinary press roll with relatively large recesses for transporting water can be arranged within the loop of the felt. In contrast, in other embodiments of the invention, a shoe press roll having a relatively thin flexible press jacket which can be provided only with relatively small recesses for the transporting of water is arranged within the felt loop.

In many embodiments of the invention, a pair of press rolls is present which forms a feltless press nip, particularly between two smooth press roll outer surfaces, which surfaces both come into direct contact with the web. One of the two press rolls is an "ordinary tubular roll" and the other is a "shoe press roll". The latter has a ledge which presses the respective tubular press jacket of the shoe press roll against the normal tubular roll. The ledge is displaceable radially relative to the stationary support member of the shoe press roll in order to be able to open and close the press nip and to be able to vary the pressing force, if necessary, during operation. Both press rolls can thus be supported rigidly on the foundation or frame. This provides an extremely simple but nevertheless variable arrangement. The width of the press nip can be determined by the shape of the slide surface of the ledge, namely convex, flat, or concave.

These advantages make this feltless pair of press rolls clearly superior to a pair of normal tubular rolls, which are known, for instance, from references D2 or D5.

The sequence of the two press rolls in the web path, i.e. whether the web transfers from the shoe press roll to the normal tubular roll, or vice versa, can be selected as desired. However, the first mentioned variant is preferable, since the outer surface of the later roll in the web path should as a rule be harder than that of the earlier roll in the web path and since the flexible jacket of the shoe press roll cannot be of any desired hardness. On the other hand, the roll covering of the normal tubular roll can be made with as great a hardness as desired.

For the aforementioned reasons, the pair of press rolls described is also superior to a pair of rolls formed of two shoe press rolls, which is known from reference D6, since it is difficult, if not impossible, to produce two flexible press jacket surface hardness values which differ to a sufficient extent in the two shoe press rolls.

The pair of press rolls is combined with additional press rolls, particularly to form felted press nips, which are press nips which serve to intensively remove water from the web. For this reason, the shoe press roll has at least one radially movable, concave press shoe which forms a felted, lengthened or extended press nip in cooperation with another press roll. In addition, the tubular roll, together with an additional press roll, which is also preferably a shoe press roll, can form another felted preferably lengthened press nip. This produces an extremely compact press section with two felted water removal press nips of high capacity.

If the belt, for instance a wire belt, conducting the web to the press arrangement contacts the top side of the web, additional advantages are obtained, as compared with reference D3. The press rolls lie approximately at the same height as the preceding wire section and as the following drying section. Thus, high stilted, tall frames which are subject to vibration are avoided. Furthermore, the machine is easier to operate, as that is done at least predominantly from the machine floor. In the first dryer group or at the first dryer cylinder of the drying section which follows the press arrangement, the bottom of the web, rather than its top, may come into contact with the drying cylinder so that easier removal of broke is assured. The more favorable guidance of the web through the second press nip is particularly important, as already mentioned, so that space is gained for at least one additional press nip, including a third press nip for smoothing of the web.

Technical expressions used herein are to be understood to include all their known variants. For instance, "felt" or "felt belt" also mean any other type of belt, for instance press wire, which serves the purpose of receiving water which is squeezed out of the web of paper. A "press roll" can have a rotatable roll body, with or without a roll covering, or can be developed as a so called shoe press unit with a stationary support body which supports either a rotating flexible press belt, which is open on both lateral sides of the machine, or a rotating flexible press jacket, which is closed oil tight on both lateral sides of the machine. In the latter case, the shoe press unit is a shoe press roll.

Other objects and features of the invention are described below with reference to the accompanying drawings.

DESCRIPTION OF THE PREFERRED EMBODIMENTS

Figure 1:
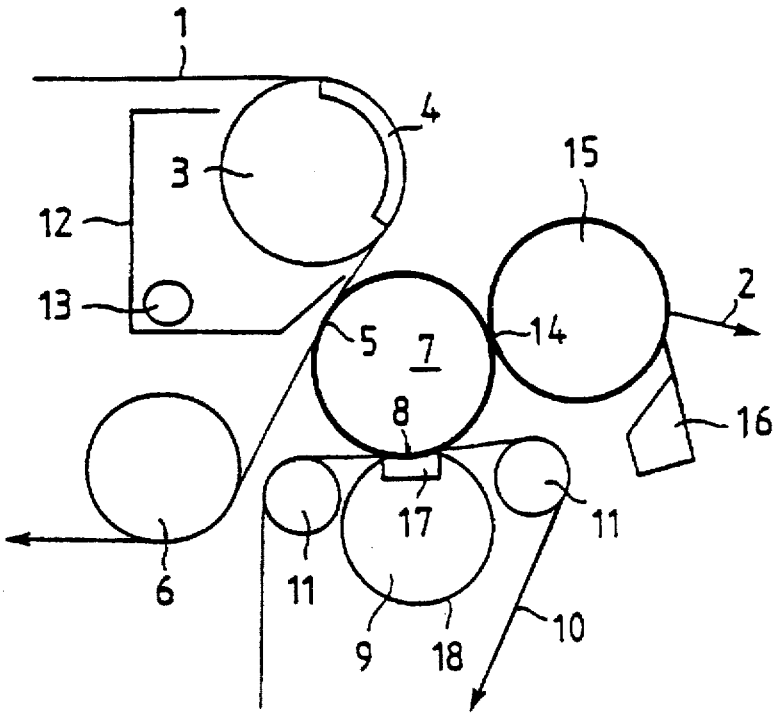
FIG. 1 is a diagrammatic side view of a wet-press arrangement with three press nips according to the invention.

In all of the drawing Figures, the smooth outer surfaces of the press rolls 7, 15, 33, which are contacted by the web and around part of the circumference of which the web is carried are indicated by relatively thick lines.

In FIG. 1, a paper web 2 is supported on a wire belt (wire) 1, which is in contact with the bottom side of the web. The wire and web wrap around a wire suction roll 3 which has a suction zone 4, and travel through a first press nip 5. The wire 1 travels further without the web over a guide roll 6 and back to the start position. The paper web 2 is transferred at the first press nip 5, in which the tensioned wire 1 partially wraps around the press roll 7, onto the smooth surface of the first press roll 7. The upper side of the paper web adheres to the roll 7 and is carried on the roll into the second press nip 8 between the first roll 7 and a second press roll 9. An endless loop press felt (felt) 10, only partially shown, moves together with the paper web 2 through the second press nip 8. The path of travel of the felt 10 both before and after the press nip 8 is determined by felt guide rolls 11. Customary additional devices on the endless loop felt 10, such as water removal and cleaning elements, for instance, a pipe suction device, a felt tensioning roll, a regulating roll, and possible further guide rolls, are not shown. See FIG. 19 with regard to these.

The wire suction roll 3 has a water collection trough 12 with a lateral outlet connection 13 associated with it.

After the second press nip 8, the web is carried on the surface of the first roll 7 into a third press nip 14 between the smooth first roll 7 and a third roll 15 with a smooth outer surface. The web of paper 2 adheres to the surface of the roll 7. In the third nip, the web is again pressed and thereby smoothed. The web leaves the third press nip 14 in contact with the surface of the roll 15 and travels around the roll to where the web is removed from the roll 15 at a certain distance before a scraper 16. As shown in FIGS. 1–4, the web is removed from roll 15, and conducted out of the press arrangement, in essentially the machine direction, corresponding substantially to the direction in which wire 1 is running. The web can be removed by pulling on it without providing support for the web or can be removed, without pulling on the web, by contacting the web with another (not shown) movable support surface which the web 2 follows after it separates from the roll 15, for instance a felt, a dryer wire, a belt or a roll.

Second press roll 9 is shown as a known tubular press roll having a stationary press shoe 17 with a concave pressing surface in the region of the press nip 8. Over the shoe surface there lies, in known manner, a layer of lubricant on which slides a flexible tubular press jacket 18 of plastic. The press shoe is movable radially in known manner for varying the pressing force in the press nip 8. With respect to the press shoe 17, press rolls of this type are hereinafter referred to as "shoe press rolls".

For clarity of the drawing, the load bearing parts, such as frame, shafts, and supports, are not shown. See, however, FIG. 20 which shows, inter alia, that the press roll 15 is movably mounted, relative to the press roll 7.

Figure 2:
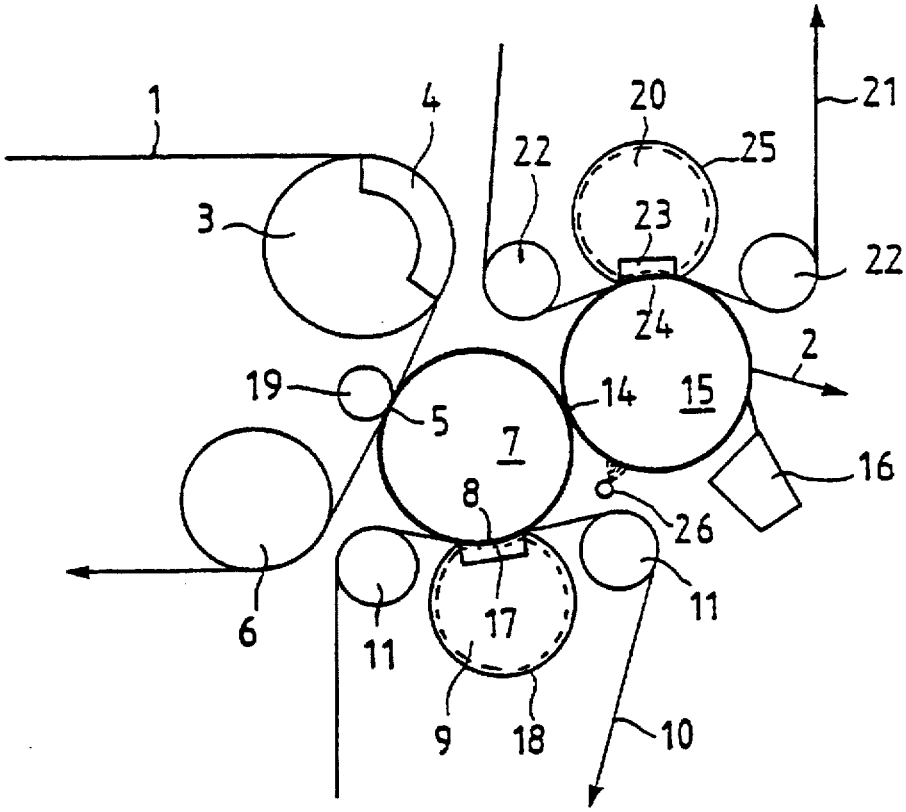
FIGS. 2 and 3 are the same type of views showing alternative arrangements with four press nips.

FIG. 2 shows a similar wet press arrangement as seen in FIG. 1. Identical parts are identified by the same reference numerals. The arrangement in FIG. 2 is expanded over FIG. 1 by additional components. In the first press nip 5, the pressure between wire 1 and roll 7 is produced not only by partial wrapping of the tensioned wire 1 on the roll 7, but in part also, or even entirely (as shown), by a pressing element 19. The element 19 can be developed as a rotating roll or as a stationary ledge. The pressing element 19 is movable and can be pressed radially against the roll 7.

Between the third press nip 14 and the scraper 16, there is an additional fourth press nip 24 between the third roll 15 and a press roll 20 with a press shoe 23 and a rotating flexible press jacket 25. An endless loop press felt 21 is conducted over guide rolls 22 through the press nip 24. The symmetrical removal of water from the web in the second press nip 8, toward the bottom side of the web into the pressing felt 10 and in the fourth press nip 24 toward the top side of the web into the second press felt 21, assures minimal structural two sidedness of the web.

The following applies also to FIG. 1 and to most of the following Figures: No water, or only a small amount of water, can be removed from the web 2 in the third press nip 14 because no water absorbing felt is present there. This press nip primarily serves for transferring the web 2 from the roll 7 to the roll 15, while simultaneously smoothing the web. The transfer from roll 7 to roll 15 is effected either through the roll 15 having a harder surface than the roll 7 and/or by moistening the surface of the roll 15, for instance, by means of a roll doctor (not shown) or by a spray pipe 26. A water collection trough (12 in FIG. 1) below the wire suction roll 3 is not shown in FIG. 2, but one can be used there. In order to increase the water removal capacity of the press, the outer surfaces of the press jackets 18 and/or 25 can be provided with fine recesses, for instance blind holes, (represented symbolically by dashed lines). If, however, on the contrary, relatively little water removal capacity is required, then the shoe press roll 20 can be replaced with an ordinary, for instance a grooved, tubular roll.

Figure 3:
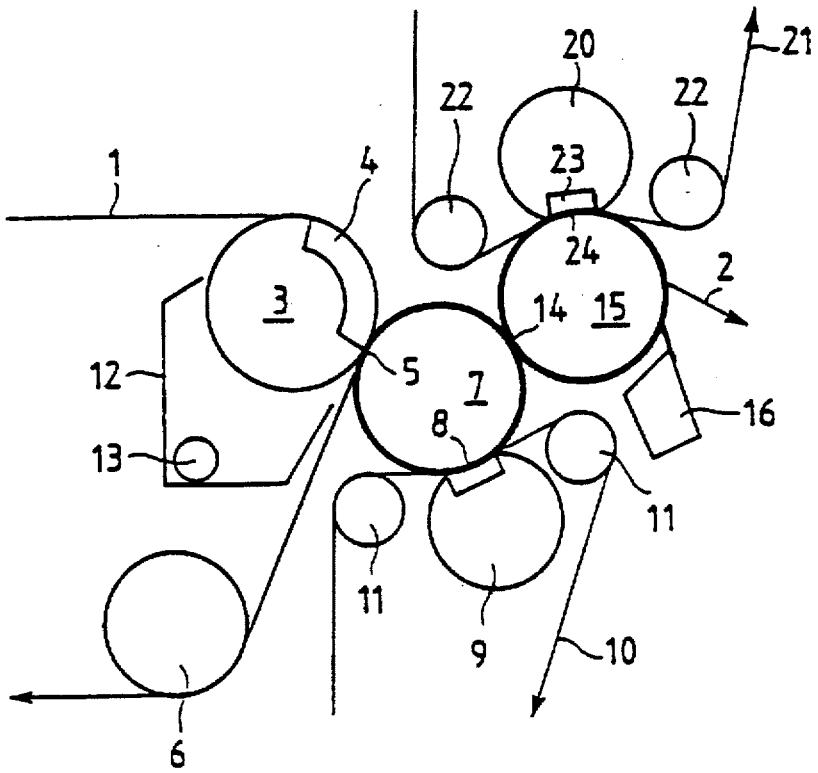

FIG. 3 corresponds in most details to FIGS. 1 and 2. Only the pressing element 19 is absent. Instead, the first press nip 5 is formed directly between the wire suction roll 3 and the first press roll 7. Due to the large diameters of the rolls 3 and 7, the pressing can be effected with considerable linear force applied at this press nip, so that the web of paper passes with a greater degree of dryness into the second press nip 8. As a result, the press nip S is more efficient at removing water.

Figure 4:
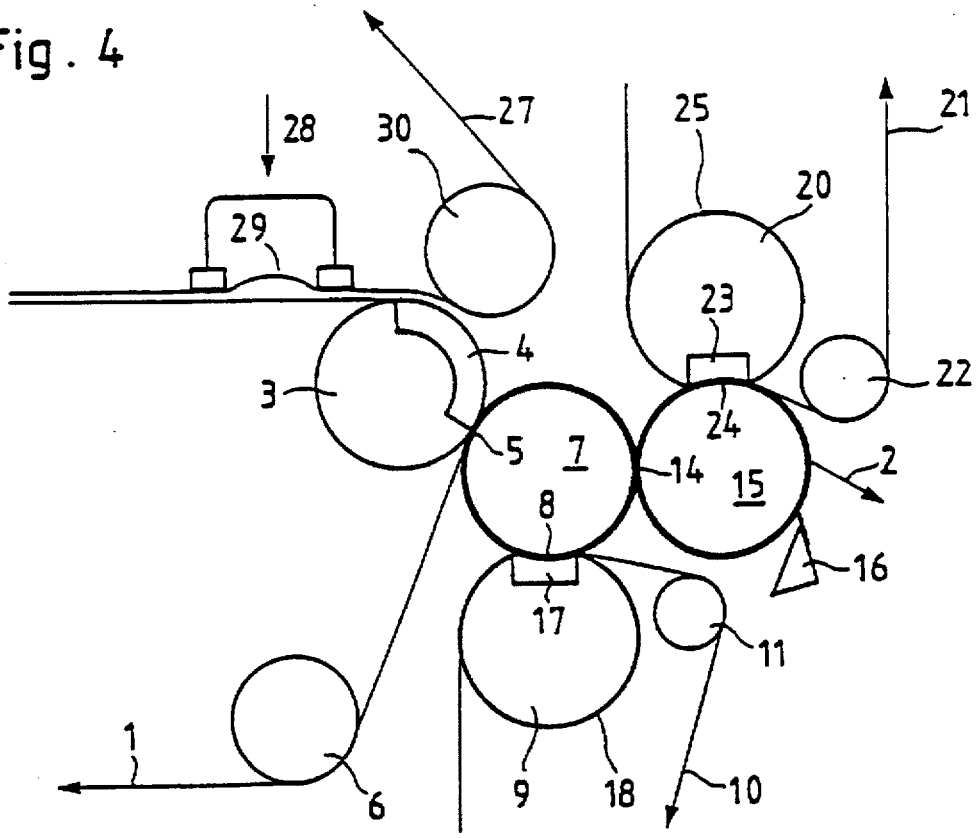
FIG. 4 shows another alternative with four press nips and preceded by a twin-wire section.

FIG. 4 corresponds in construction and function substantially to FIG. 3. However, on the respective paths of the two press felts 10 and 21 to the press nips 8 and 24, those felts wrap around the respective press jackets 18, 25 of the rolls 9, 20, instead of wrapping around additional guide rolls 11, as in FIG. 3. Furthermore, the wire 1 is the bottom wire of a twin-wire former. The paper web 2 is guided between the lower wire 1 and an upper wire 27 and under a wide jaw suction chamber 28. There the top wire together with the web are deflected upward in an arcuate shape path within the vacuum slot 29 of the box 28. The width of the slot 29 in the wire travel direction is preferably between 50 and 150 mm. Several slots of a width of more than 40 mm can also be used. Loose fibers of the web 2 which extended downward into the meshes of the bottom wire 1 are pulled out of that wire 1 and apply themselves, due to surface tension forces and the action of vacuum in the suction chamber 28, flat against the bottom of the paper web 2. Furthermore, due to the elongation of the path of the wire 27 with respect to the path of the wire 1, there is relative displacement of the two wires in the direction of travel so that, when the wire 1 and web 2 again come into contact with each other following the suction chamber 28, the loose web fibers no longer fit into the same wire mesh. As a result of this consolidation of the paper web 2, greater dryness of the paper is already obtained at the first press nip 5. Furthermore, wire markings in the web 2 are thereby reduced. After separation from the web 2, the upper wire 27 travels back over the guide roll 30 to the web forming zone of the web former.

Figure 5:
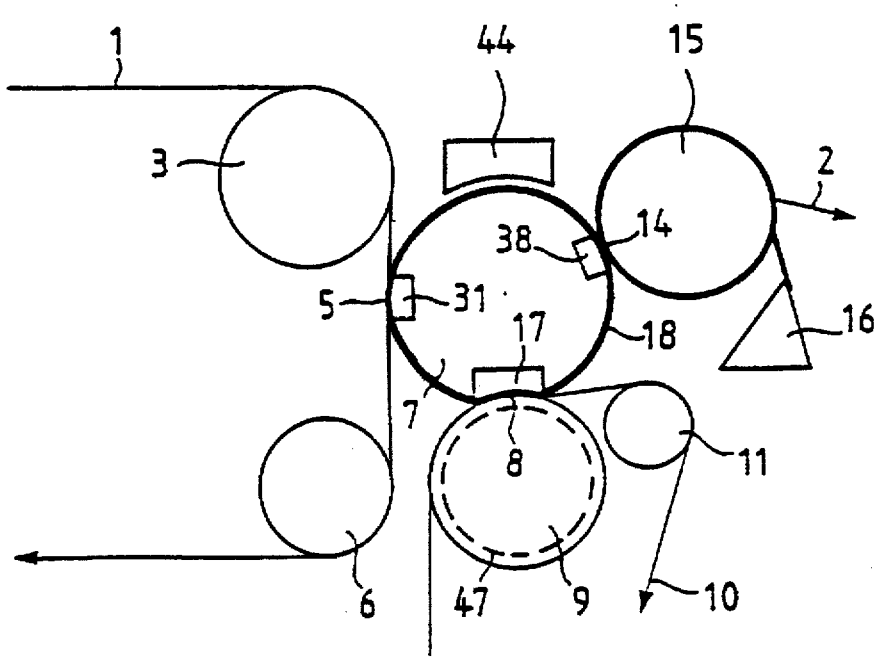
FIG. 5 shows an alternative to FIG. 1 with three press nips.
Figure 6:
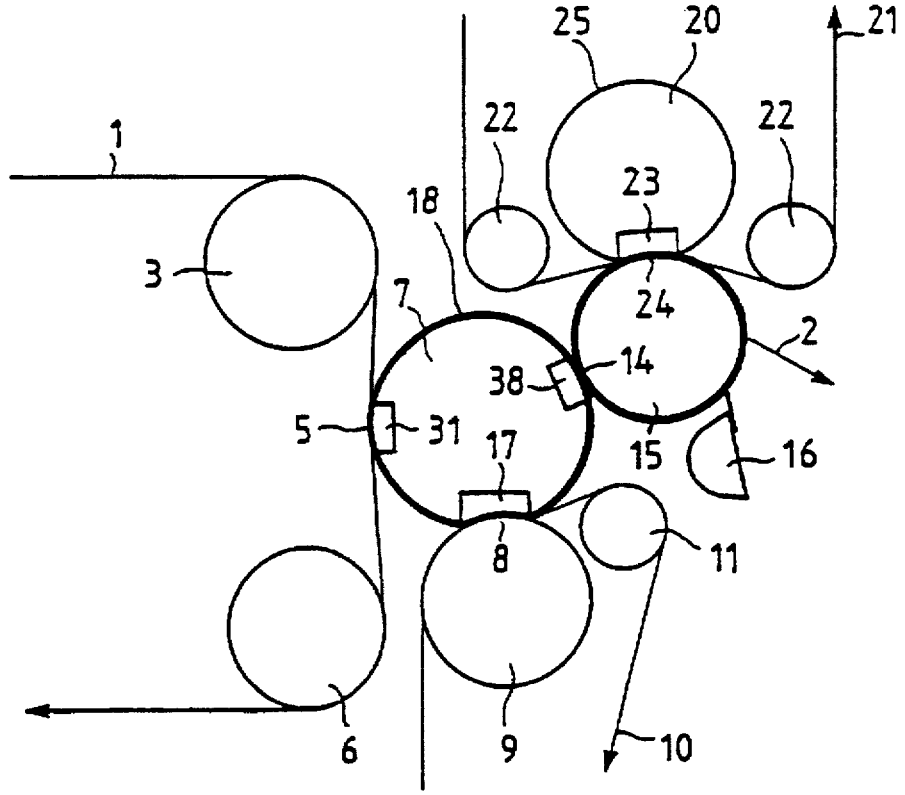
FIG. 6 shows an alternative to FIGS. 2 to 4 with four press nips.

FIGS. 5 and 6 show further alternatives to FIGS. 1 and 2, in which the first press roll 7 is a shoe press roll with a press shoe 17, a flexible press jacket 18 moving over the shoe 17, and a press jacket cleaning device 44. The second press roll 9 has a normal, tubular roll body. In the examples of FIGS. 1 to 4, the press jacket 18 can have grooves 47 or blind holes (see FIG. 2) in its outer surface. The press jacket 18 in FIGS. 5 and 6 is developed with a smooth outer surface because it is at the position to pick the web off the wire 1, as shown in FIGS. 5 and 6. On the other hand, the outer surface of the second roll 9 contains grooves or blind holes, represented symbolically in FIG. 5 by a dashed-line circle 47, like the jacket of the second roll 9 in FIGS. 1 and 2.

The pressing forces to be applied in the first and third press nips 5 and/or 14 can be varied by arching the flexible press jacket 18 outward to a greater or lesser extent by means of circumferentially separated, radially movable support ledges 31, 38. Due particularly to the movable ledge 38, which cooperates with the normal tubular roll 15, displacement of the, for instance, four (see FIG. 6) heavy rolls 7, 9, 15 and 20 can be dispensed with. In other words, this movable ledge feature of the embodiments of FIGS. 5 and 6 makes it possible for each of the two pairs of rolls 9 and 7 and 15 and 20 respectively to be supported rigidly on machine frames, foundation plates, or the like. No roll need be mounted in swing levers, or the like, as shown, for instance, in FIG. 20 for the roll 15. Nevertheless, four press nips 5, 8, 14, and 24 are present in FIG. 6, and the pressing forces are individually adjustable at each press nip. The advantages just mentioned are also obtained with the embodiments in FIGS. 8, 11, 12, 15, 18, 19, and 24. However, there are preferred constructions in which only a single shoe press roll with a smooth press jacket is present and in which, therefore, a radially displaceable ledge cooperates with a normal tubular roll resting in unmovable supports. See FIGS. 5–8, 12, 15, 19, and 24.

The slide surface of the support ledge 31 is of convex curvature, and its radius of curvature determines the degree that the press jacket 18 bulges. The slide surface of the support ledge 38 can also be convexly curved. However, a flat or concavely curved slide surface, similar to that of the press shoe 17, is also possible.

Figure 7:
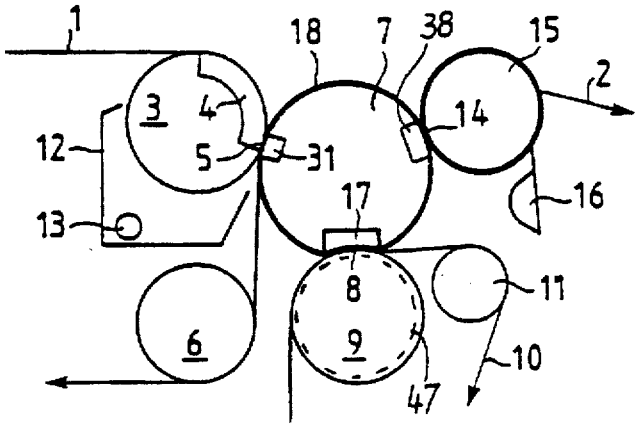
FIG. 7 shows a further alternative to FIG. 1.

FIG. 7 shows an alternative to FIG. 5 in which the first press nip 5 is located directly between the rolls 3 and 7.

Since a higher linear force is intended in the first press nip 5, the flexible press jacket 18 must again be supported in the region of the press nip 5 by a pressing ledge 31, which is guided on the stationary support member (not shown) of the shoe press roll 7. In order to make movement of the large rolls unnecessary, the ledge 31 is radially movable and is pressed against the roll 3. A layer of lubricant, which layer is produced hydrostatically or hydrodynamically, assures low friction sliding of the jacket 18 over ledge 31. The slide surface of that ledge can again be convex, flat, or concave. In the latter case, its curvature is adapted to the diameter of the roll 3.

Figure 8:
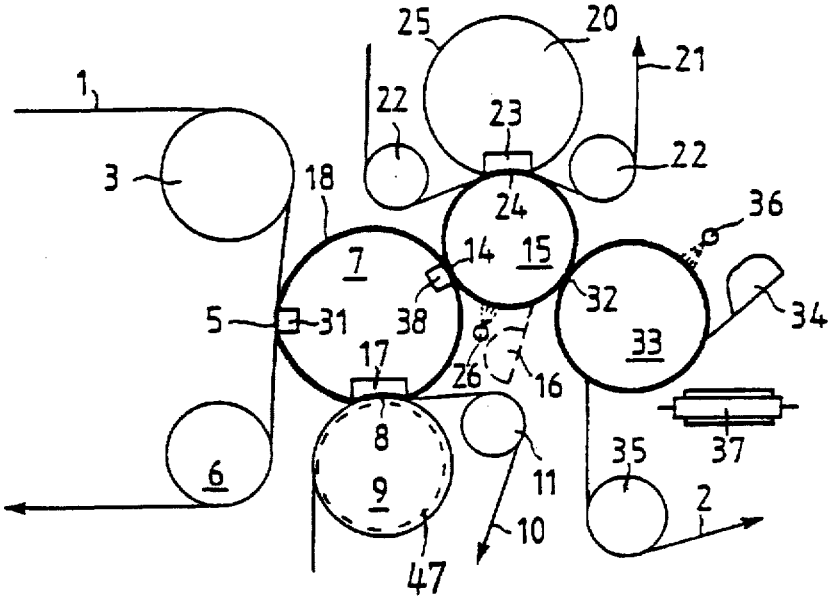
FIGS. 8 and 9 show arrangements with five press nips.

FIG. 8 shows a further development of FIG. 6. There is a fifth press nip 32 between the press rolls 15 and 33, where the paper web is smoothed on both sides. In order that the paper web 2 might follow the roll 33 rather than the roll 15 upon leaving the fifth press nip 32, the surface layer of the roll 33 is harder than that of the roll 15. An additional effect of this difference in hardness is that a stronger smoothing effect is produced on the top side of the paper web, which has a rougher structure due to rubbing by the second felt 21, than on the bottom side, so that the emerging paper web 2 is of substantially equally good smoothness on both sides. The web 2 travels further over guide roll 35 to the drying section. A scraper 34 cleans off the surface of the roll 33. A scraper 16 can, if necessary, be associated with the roll 15.

The surface layer of the tubular roll 15 is preferably harder than that of the press jacket 18. Thus, the surface hardness of the roll 15 is greater than that of the roll 7, and the surface hardness of the roll 33 is greater than that of the roll 15. Moistening spray pipes 26 and 36 can be provided in front of the press nips 14 and 32 for additionally facilitating the transfer of the web onto the desired roll surface. For removing broke which may accumulate at the scraper 34, a conveyor belt 37 is provided, which extends transversely over the width of the machine. At the press nips 5 and 14, the flexible press jacket 18 is again bulged outward by support ledges 31 and 38.

Figure 9:
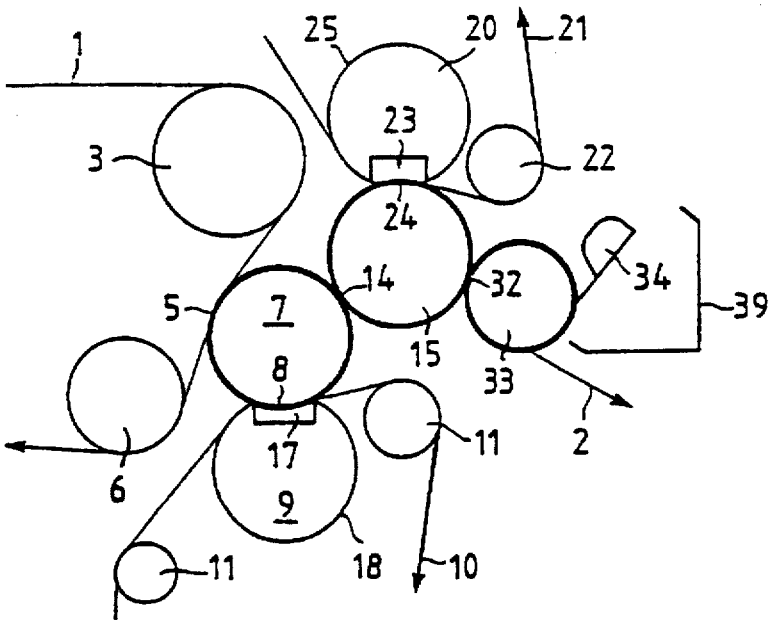

FIG. 9 corresponds to the wet press arrangement of FIG. 8. In this case, the roll 7 is developed as a normal tubular roll while the roll 9 is developed as a shoe press roll with a flexible jacket. Instead of a conveyor belt 37 being provided below the scraper 34, only a collection trough 39 is present.

Figure 10:
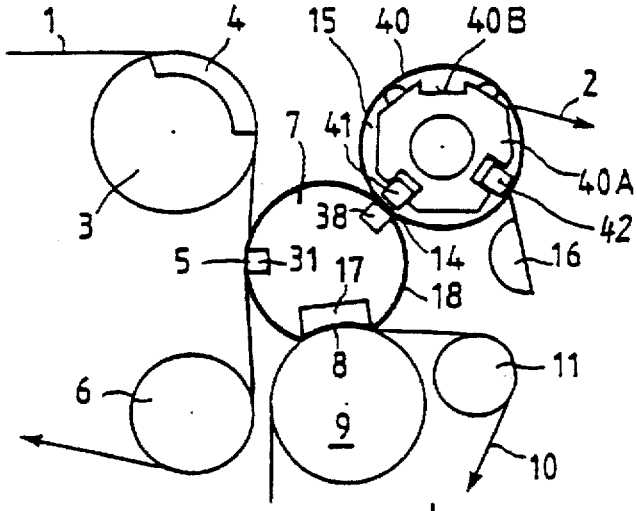
FIGS. 10 and 11 show arrangements in which the web of paper lifted off the wire first follows the smooth surface of a first flexible press jacket and then the smooth surface of a second flexible press jacket.

FIG. 10 is a further alternative to FIGS. 1 and 5. In this case, the rolls 7 and 15 are shoe press rolls with respective flexible, smooth, tubular press jackets 18 and 40. Shoe press roll 7 has a press shoe 17 with a concave slide surface. Shoe press roll 15 has no such press shoe since it does not form a felted water removal press nip. It merely has support ledges 41 and 42 respectively at the press nip 14 and opposite the blade of the scraper 16. All support ledges 31, 38, 41, 42 can optionally be rigid or radially movable. Of the two support ledges 38 and 41 which cooperate with each other, usually only one is movable. The length of the press nip 14 can again be determined by the shape of the slide surfaces, i.e. convex with any desired radius, or flat. It is also possible for one of the support ledges, for instance 38, to be concave while the other ledge is 41 convex. The diagrammatically indicated support member 40A of the roll 15 has a recess 40B for a press shoe 45, if such a shoe is to be subsequently installed, together with rolls 20, 22 and felt 21, as illustrated in FIG. 11.

Figure 11:
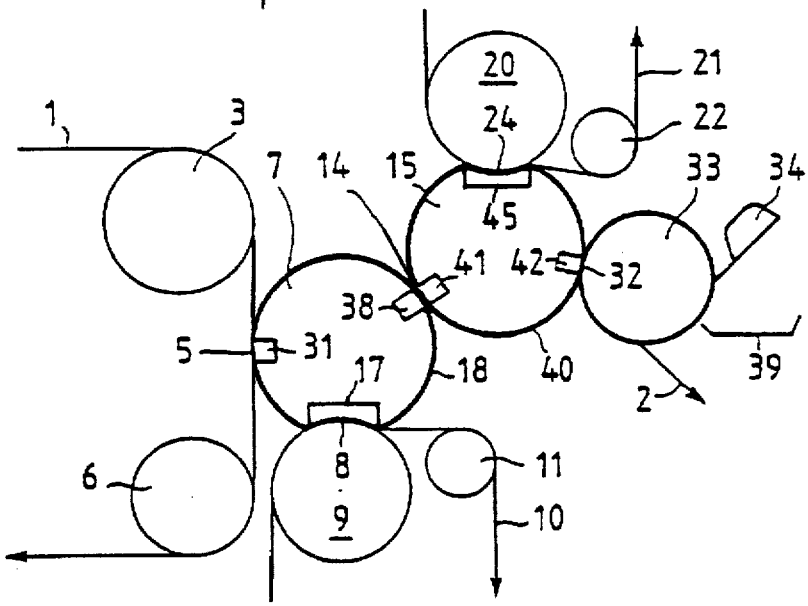

FIG. 11 shows an alternative to FIG. 9, in which, as in FIG. 10, the rolls 7 and 15 are developed as shoe press rolls, but the rolls 9 and 20 are normal tubular rolls.

Figure 12:
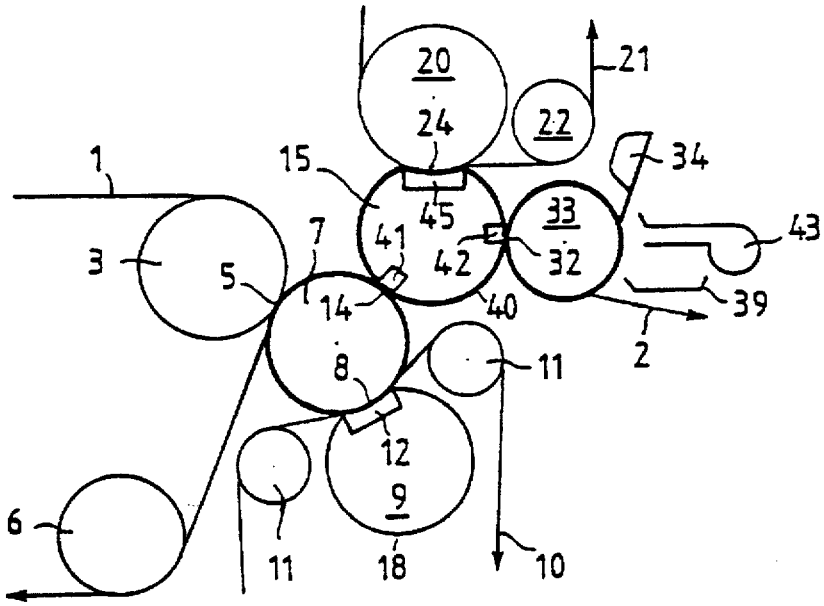
FIG. 12 shows a further arrangement having five press nips.

FIG. 12 shows another possible variant to FIGS. 8, 9 and 11, in which, in contrast to FIG. 11, roll 7 is a normal tubular roll and roll 8 is a shoe press roll with a flexible rotating press jacket 18. Below scraper 34, there is a broke removal nozzle 43. The surface hardness of the rolls 7, 15 and 33 is again preferably stepped. The outer surface of roll 33 is harder than that of press jacket 40 and the surface of the latter is harder than that of roll 7. In a variant (not shown) of FIG. 12, the shoe press roll 9 can be replaced by a normal, for instance, grooved, tubular roll, if relatively slight water removal ability is sufficient at the press nip 8.

Figure 13:
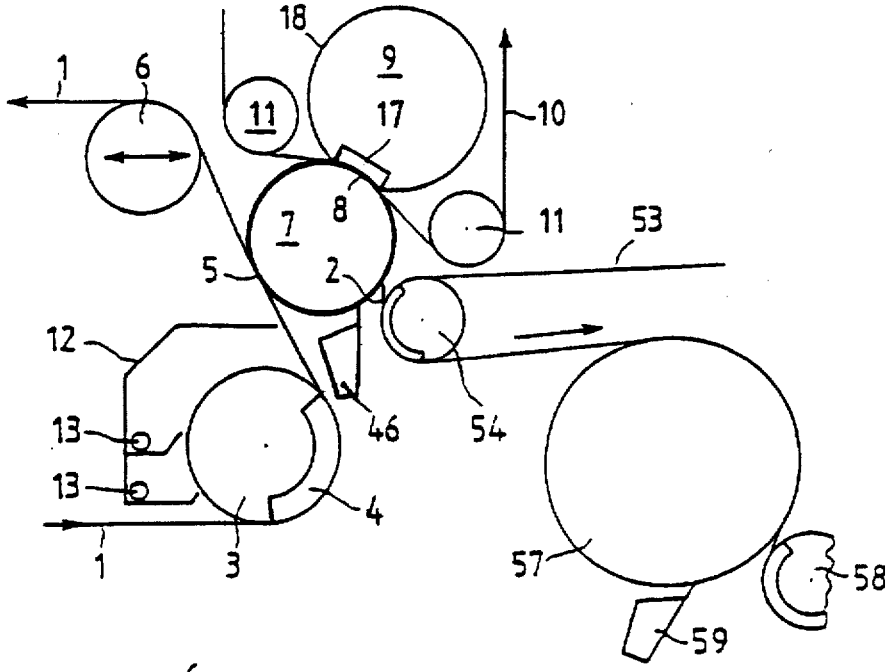
FIG. 13 shows a wet-press arrangement having two press nips with removal of the web from an upper wire.

In FIG. 13, a paper web 2 is conducted from below to above along with an upper wire 1, where the top side of the web is in contact with the wire, then over a wire suction roll 3 having a suction zone 4, to a first press nip 5 which is arranged at only a slight distance above the wire suction roll 3. The wire travels from here further over a guide roll 6 on a return path. The paper web 2 is transferred in the first press nip 5 onto the smooth surface of the press roll 7 and then passes, with its lower side adhering to the roll 7, into the second extended press nip 8 between the roll 7 and a further press roll 9. Together with the paper web 2, a press felt 10, shown only in part, is conducted through the second press nip 8. Before and after the press nip 8, the felt 10 travels over guide rolls 11. The rest of the endless felt loop, together with the customary corresponding components, has not been shown. The wire suction roll 3 has associated with it a water collection trough with two lateral outlet connections 13. The roll 6 can be shifted horizontally for opening and closing the press nip 5 and also for varying the contact path of the wire 1 on the press roll 7, as indicated by a double-ended arrow. The circumference of the roll 7 is cleaned by the scraper 46. The wire 1 travels in a counterclockwise direction as shown by arrows in FIG. 13, in contrast to the wires in FIGS. 1–12. The direction of travel of the felt 10 through the press nip 8 differs only slightly from the horizontal. This enables a dryer wire roll 54 to be arranged directly alongside the roll 7. A dryer wire 53 travels over the roll 54. The wire 53 transports the web 2 in a known manner to a first dryer cylinder 57, which contacts the bottom side of the web, and then over additional rolls and cylinders, of which only the roll 58 is visible.

Figure 14:
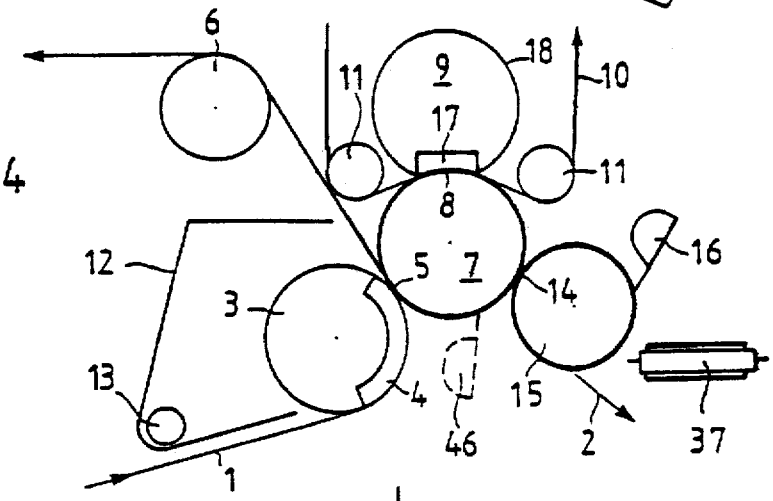
FIG. 14 shows a similar arrangement with an additional third press nip.

In FIG. 14, the wet press arrangement of FIG. 13 is expanded by an additional feltless third press nip 14 which provides after smoothing of the top side of the paper web 2, which side had been roughened by felt 10. This smoothing is effected with the roll 15 pressed against the paper web 2. Scraper 46 on roll 7 can possibly be dispensed with. Scraped material obtained at scraper 16 is transported further laterally out of the machine by the conveyor belt 37.

Figure 15:
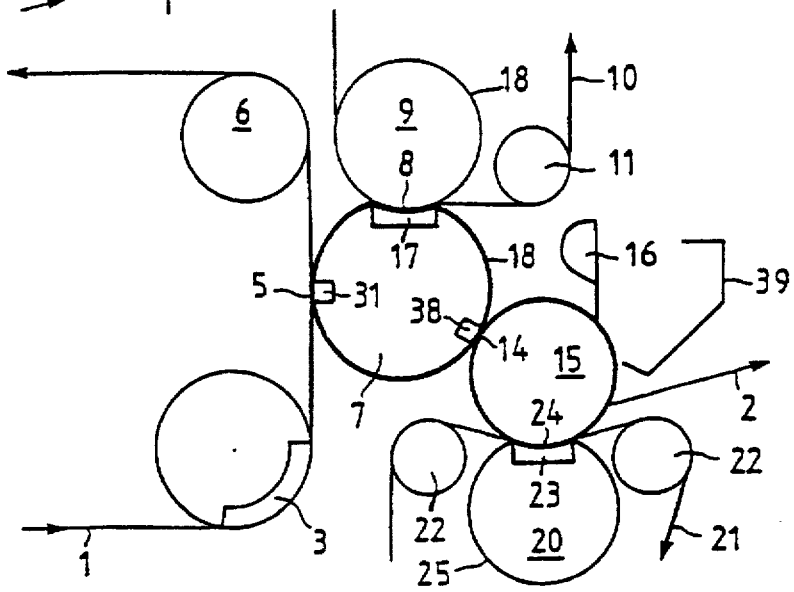
FIG. 15 shows a press arrangement similar to that in FIG. 14, but with four press nips.

The embodiment in FIG. 15 adds a second shoe press roll 20 with a felt 21. Furthermore, and contrary to FIG. 14, roll 7 is a shoe press roll and roll 9 is a normal tubular roll. Circumferentially separated, radially movable support ledges 31 and 38 of roll 7 transmit the pressing forces in the first and third press nips 5 and 14, respectively, to the flexible jacket 18 of the roll 7.

Figure 16:
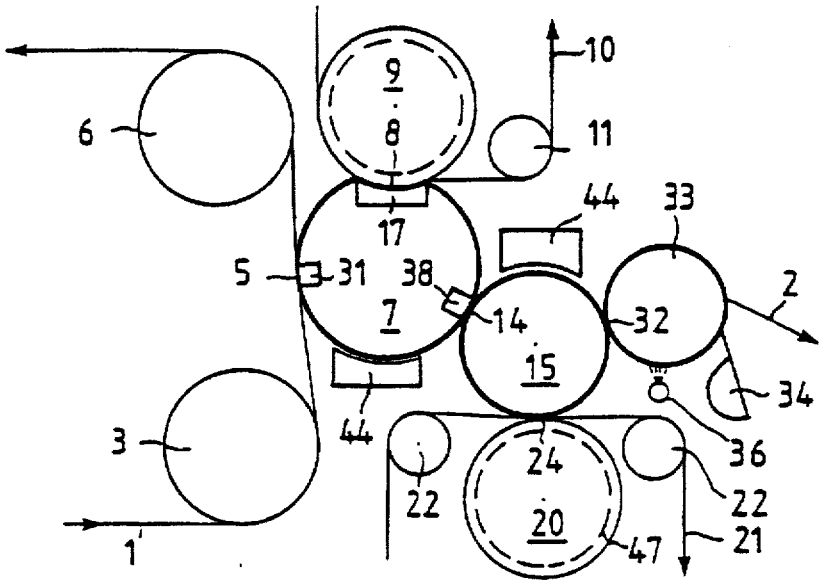
FIG. 16 shows a press that corresponds to FIG. 15, but which is expanded to five press nips.

The press in FIG. 16 has an additional press roll 33 with a hard smooth outer surface, in contrast to the arrangement of FIG. 15. At the fifth press nip 32, the top side of the paper web, which had been roughened by the felt 10, is smoothed. The hardnesses of the outer layers of the rolls which carry the web increase in the direction of web travel, from roll 7 via roll 15 to roll 33.

In FIG. 16, roll 20 is not a shoe press roll. The third press nip 24 is therefore not an extended press nip. A moistening spray pipe 36, which sprays onto roll 33, assures the transfer of the web from the press roll 15 to the press roll 33 after the nip 32. Roll cleaning devices 44 are provided for the continuous or intermittent cleaning of the rolls 7 and 15. The scraped material obtained at the scraper 34 drops downward, for instance into a broke vat.

Figure 17:
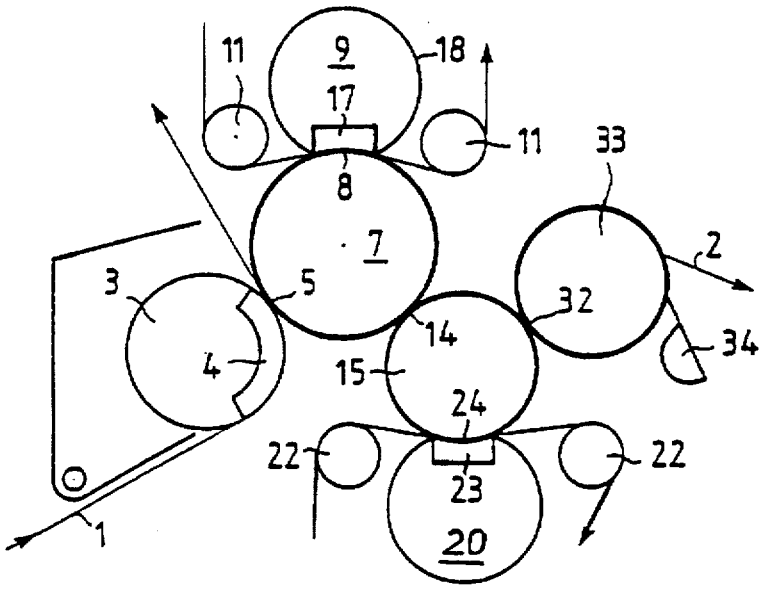
FIGS. 17 and 18 are alternatives to the press arrangement in FIG. 16.

FIG. 17 shows an alternate embodiment of the press according to FIG. 16. FIG. 17 differs from FIG. 16 in that the roll 7 is a rigid tubular roll and the roll 9 is a shoe press roll. Furthermore, the roll 20 is also a shoe press roll. For roll 20, as well as fundamentally in the case of each roll lying in the loop of a felt, the felt contacting outer surface of the roll can be provided with grooves or blind holes, as shown schematically at 47, FIG. 16.

Figure 18:
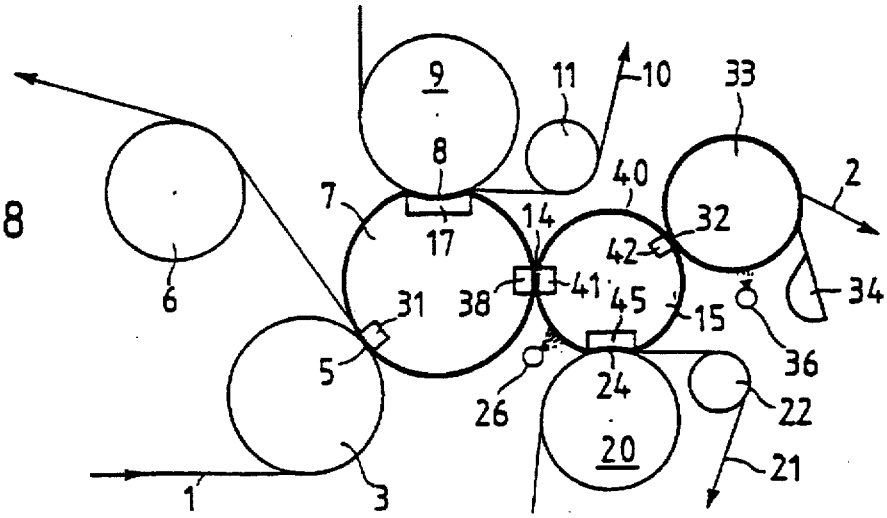

The embodiment of FIG. 18 is a further alternative to FIGS. 16 and 17, in which the two rolls 7 and 15 are shoe press rolls. The press roll 7 has the features of the corresponding roll in FIG. 16. Roll 15 has a tubular jacket 40. Shoe press 45 defines an extended nip 24 with tubular roll 20. Ledge 41 cooperates with ledge 38 in the jacket of roll 7 to support both jackets in contact to define a feltless nip 14. Similarly, ledge 42 in jacket 40 presses the jacket 40 against the surface of roll 33 to define the feltless nip 32.

Figure 19:
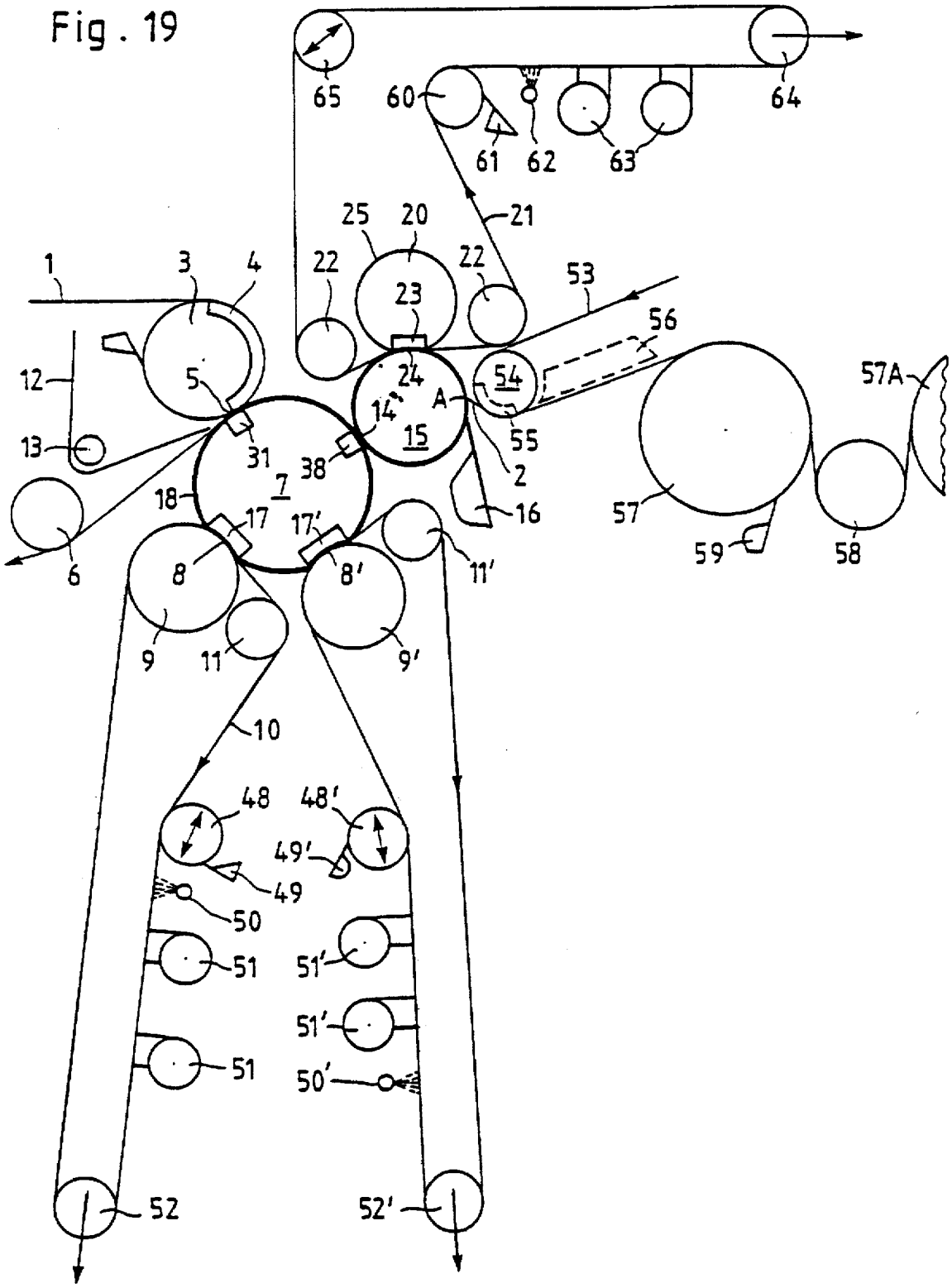
FIG. 19 corresponds to the arrangement in FIG. 6, with another felted press nip inserted between two of the press nips.

FIG. 19 shows a paper web 2 that is transported by a porous belt 1, for instance a wire belt, and the web is dewatered and/or smoothed in five press nips. The web is then carried by a dryer wire 53 past the first dryer cylinder 57.

While it is on the belt 1, the paper web 2 is conducted around a suction roll 3 with a suction zone 4 into a first press nip 5 between the rolls 3 and 7. The pressing force at the first press nip 5 is exerted by a pressing ledge 31, which is displaceable radially in the stationary support member (not shown) of the roll 7. Following the first press nip 5, the belt 1 travels over the guide roll 6, while the paper web 2 travels further on the feltless outer surface of the press jacket of the shoe press roll 17 into a second press nip 8. The press nip 8 is formed by the press shoe 17, which is also radially displaceable, and which presses via a lubricating film and then a press jacket is over the film, from one side onto the paper web 2, and from the other side by a backup roll 9 which presses via the press felt 10 onto the paper web. The press felt 10 travels over guide, regulating and tensioning rolls 11, 48 and 52 back to the press entrance at the roll 9. Roll 48 has a scraper 49. For washing the felt, there is a spray pipe 50, while suction pipes 51 serve for removal of both press and wash water. A supplementary third press nip 8', having the same elements as the second press nip 8, is provided at a supplementary roll 9'. This supplementary third press nip is an option for dewatering paper webs from which it is difficult to remove the water. The web passes from the (third) press nip 8' into the third (or fourth, if nip 8' is used) press nip 14 between the rolls 7 and 15 and thereafter travels adhering to the surface of roll 15, into a further fourth (or fifth) press nip 24 between the rolls 15 and 20.

At the press nip 24, the web 2 is pressed by a press shoe 23, via a lubricating film, the press jacket 25 and the felt 21, against the press roll 15 and the web continues traveling on the surface of the roll 15 up to a detachment point "A", where the web is drawn off the roll 15 against the dryer wire 53. This transfer is done by means of a suction zone 55 of a suction guide roll 54. Another suction device 56 can be installed near the roll 54 in order to prevent detachment of the web 2 from the dryer wire on the path from the suction guide roll 54 to the first drying cylinder 57. From the first drying cylinder 57, the paper web 2 passes, together with the dryer wire 53, over a dryer wire guide roll 58 to the second drying cylinder 57A, etc. The press felt 21 is detached after the press nip 24 from the paper web 2 in order to pass over a guide roll to a scraper roll 60 and further over tensioning roll 64, regulating roll 65, and a further guide roll 22 back to the press nip 24. The scraper roll 60 is cleaned by a scraper 61 and the felt 21 is cleaned by spray pipe 62. Spray water and press water are drawn off by the suction pipe 63.

Figure 20:
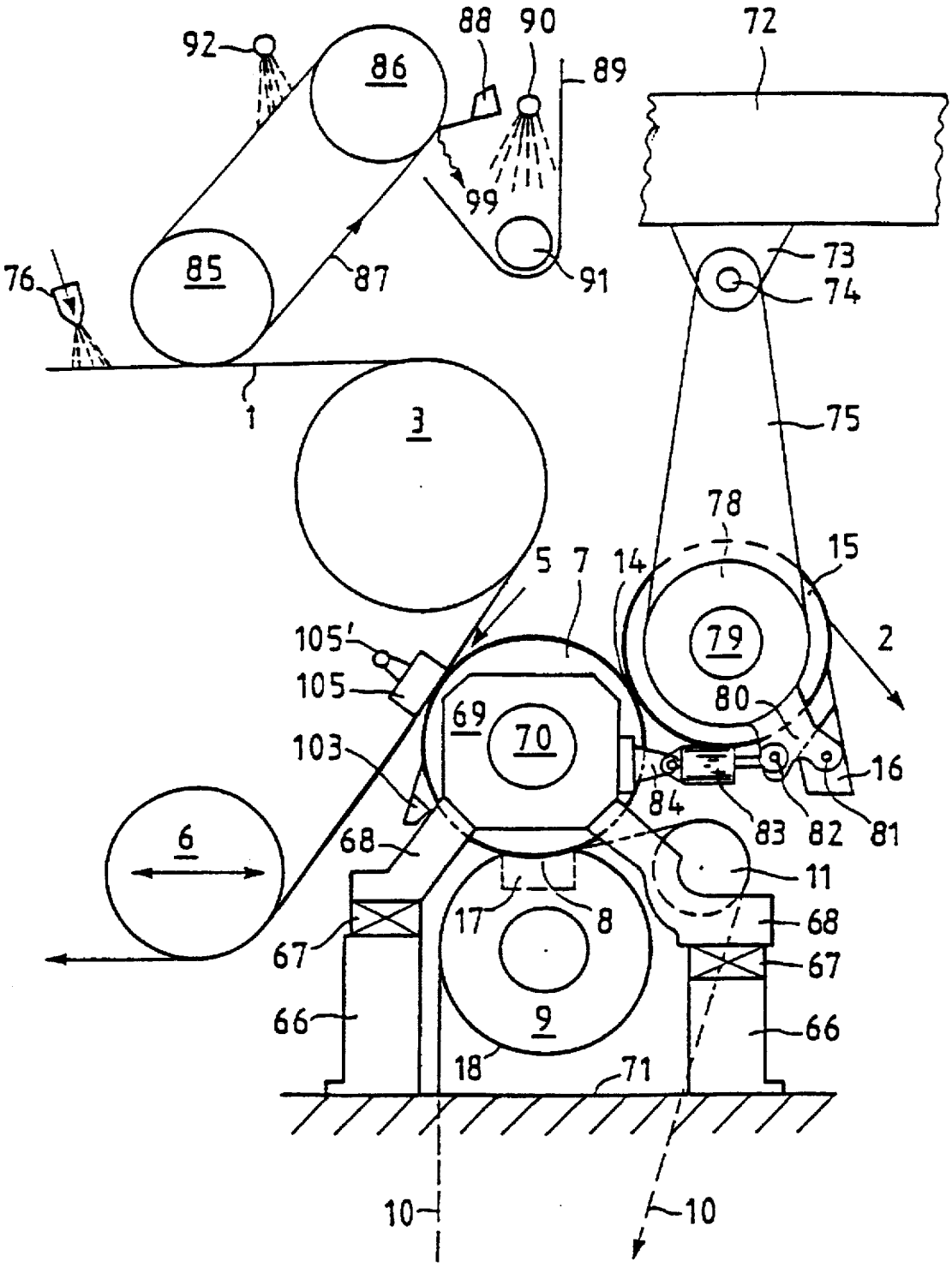
FIG. 20 shows a part of the arrangement of the frame of the wet press and shows two possibilities for removal of an edge strip of the web.

In FIG. 20, a paper web is conducted on a wire belt 1 over a roll 3 into a first press nip 5 between the belt 1 and the smooth press surface of the roll 7. The paper web 2 transfers there from the belt 1 to the roll 7. The wire belt 1 travels further over roll 6 to further processing stations (not shown) and returns, together with a web 2 in the direction toward the roll 3. While adhering to the surface of the roll 7, the paper web 2 passes into a second press nip 8 formed between the rolls 7 and 9 and then into a third press nip 14 between rolls 7 and 15. The web 2 leaves the roll 15 upstream of the scraper 16. A press shoe 17 of roll 9 presses the press jacket 18 and a felt 10 against the paper web 2, which is supported by the roll 7. The felt 10 passes through the second nip 8 and the web detaches itself from the felt 10 after the press nip 8 and the felt 10 travels downward over the guide roll 11. The felt returns from the bottom left with the jacket 18 back to the press nip 8. Horizontal displacement of the guide roll 6 to the right closes the press nip 5 in an operating position. Displacement of the guide roll 6 to the left opens that press nip. On both sides of the machine, stands 66, acting through removable intermediate pieces 67 and brackets 68, support a bearing pedestal 69 on which the roll journal 70 of the press roll 7 is supported. The journal 70 either rotates with the roll 7 or is stationary if roll 7 is a deflection controlled roll.

The stands 66 are arranged on foundation plates or beams 71. Press frames 72 are shown only in part. From the frames 72, on both sides of the machine, a support 73 with a pivot pin 74 hangs down. A press lever 75 is swingably fastened on the pin 74. The lever 75 holds the roll mounting housing 78 in which the shaft 79 of the press roll 15 is mounted. An extension 80 on the mounting housing 78 has first mounting holes 81 for receiving the swing pins of the scraper 16 and second holes 82 for the pivoting of the piston rod of the hydraulic cylinder 83. The hydraulic cylinder 83 is connected at its opposite side via a bearing bracket 84 with the bearing pedestal 69. With hydraulic cylinders 83 arranged one on the operator side and one on the driven side of the machine, the press roll 15 is either swung to the right away from the press roll or pressed against it toward the left in an operating position.

On the top left of FIG. 20, a pair of rollers 85, 86, is furthermore shown over which an endless smooth belt 87 travels at approximately the same speed as the belt 1. The belt 87 is pressed by the roller 85 against an edge strip which is sprayed off by water nozzle 76 from the paper web, which is to be further processed, and the belt 87 carries the cut off strip along with it to the roller 86. A scraper 88 scrapes the edge strip 99 off the circumference of the roller 86 into a collection trough 89. Dilution water from a nozzle arrangement 90 flushes the edge strip out of the trough 89 through a lateral outlet connection 91. A moistening spray pipe 92 moistens the surface of the belt on the return path.

As an alternative to the edge strip removal device 85 to 92, the edge strips can also be held fast by a holding suction device 105 with a vacuum connection 105' at the press nip 5 so that the strips travel further with the belt 1, while the center of the web travels around the surface of the roll 7. Another alternative for removal of the edge strip comprises scraping it from the surface of the roll 7 by edge scrapers 103.

Figure 21:
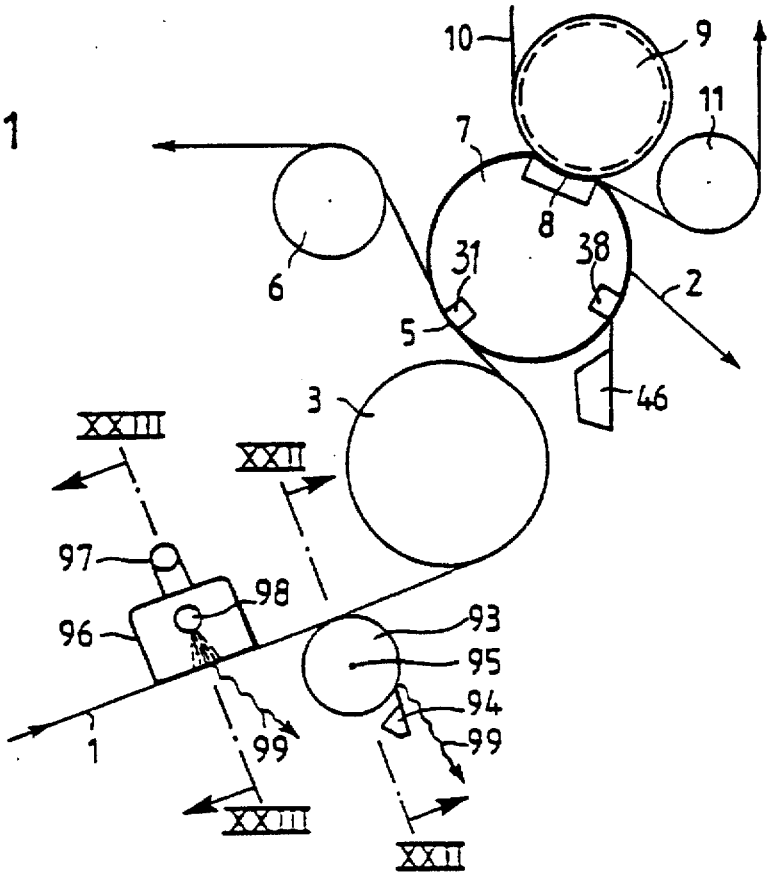
FIG. 21 shows further possibilities for removal of the edge strip of the web.

FIG. 21 shows another arrangement in which a wire 1 brings a paper web 2 over a roll 3 from the bottom to the top, up to a first press nip 5 and further over a guide roll 6. On the circumference of the roll 7, the paper web passes through a second press nip 8 and the web is detached from the roll 7 before reaching the scraper 46. Felt 10 is guided around press roll 9, travels through the second press nip 8 and further over guide roll 11. Before the web reaches the roll 3, a roller 93 is pressed against the edge strip 99 of the web 2 and lifts it off from the wire 1. Portions of the edge strip which are not removed by centrifugal force from the roller 93 are scraped off by a scraper 94. Roller 93 rotates around the shaft 95 and is driven at a circumferential speed synchronous with the speed of the wire 1 (FIGS. 21 and 22).

Figure 23:
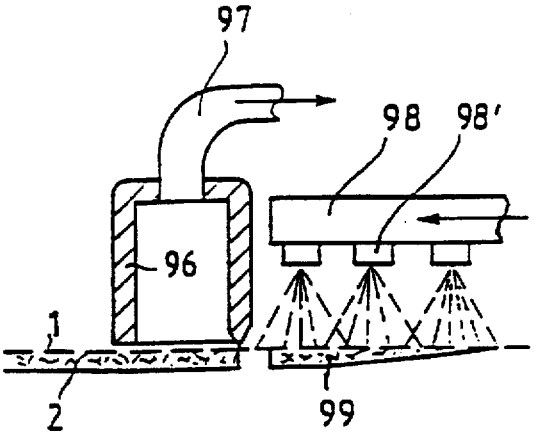

Another possibility for removing the edge strip is shown further on the left (FIGS. 21 and 23). The edge strip 99 is sprayed out of the wire by a spray pipe 98. Partition walls, or even better, holding suction means 96 assure that the edges of the web which are to be conducted further are not detached from the wire by the spray water of the spray pipe 98. The suction box 96 is evacuated via the conduit 97.

Figure 22:
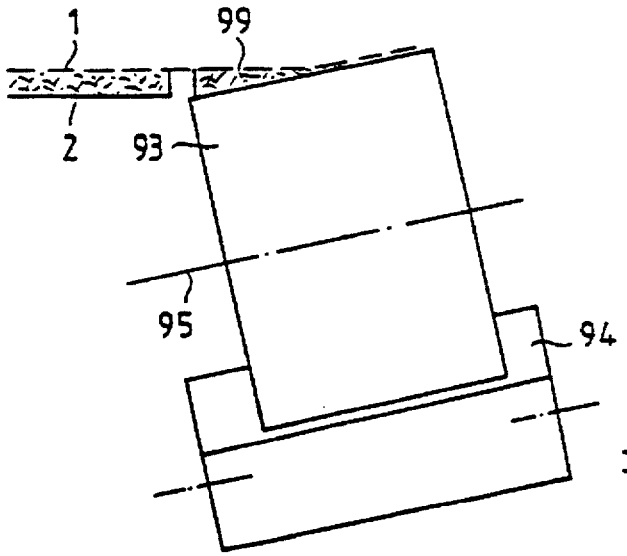
FIGS. 22 and 23 are sections through FIG. 21 at the respective section marks in FIG. 21.

FIG. 22 (section XXII of FIG. 21) shows, in cross section, the wire 1 and the web 2 adhering beneath the wire, as well as the edge strip 99 detached from the web. Such edge strips 99 become (as shown) ordinarily thinner and weaker towards the outermost edge and would cause tears of the web if they were not removed in due time from the web 2. The edge strip 99 passes along with the surface of the roller 93 to the scraper 94. The axis of the roller 93 is arranged somewhat inclined; the roller 93 is pressed against the elastically resilient wire 1. The roller 93 can alternatively also be provided with a conical outer surface, like a conical frustrum, rather than with a cylindrical surface.

In FIG. 23, (section XXIII of FIG. 21) the web 2 and the separated edge strip 99 hang down from the wire 1. The edge of the paper web 9 is held fast by the edge suction box 96 with suction connection 97 through which air is drawn off. A spray pipe 98 with nozzles 98' is fed with water under pressure. The water emerging from the nozzles is sprayed onto the wire 1 and detaches the edge strip 99 from it.

Figure 24:
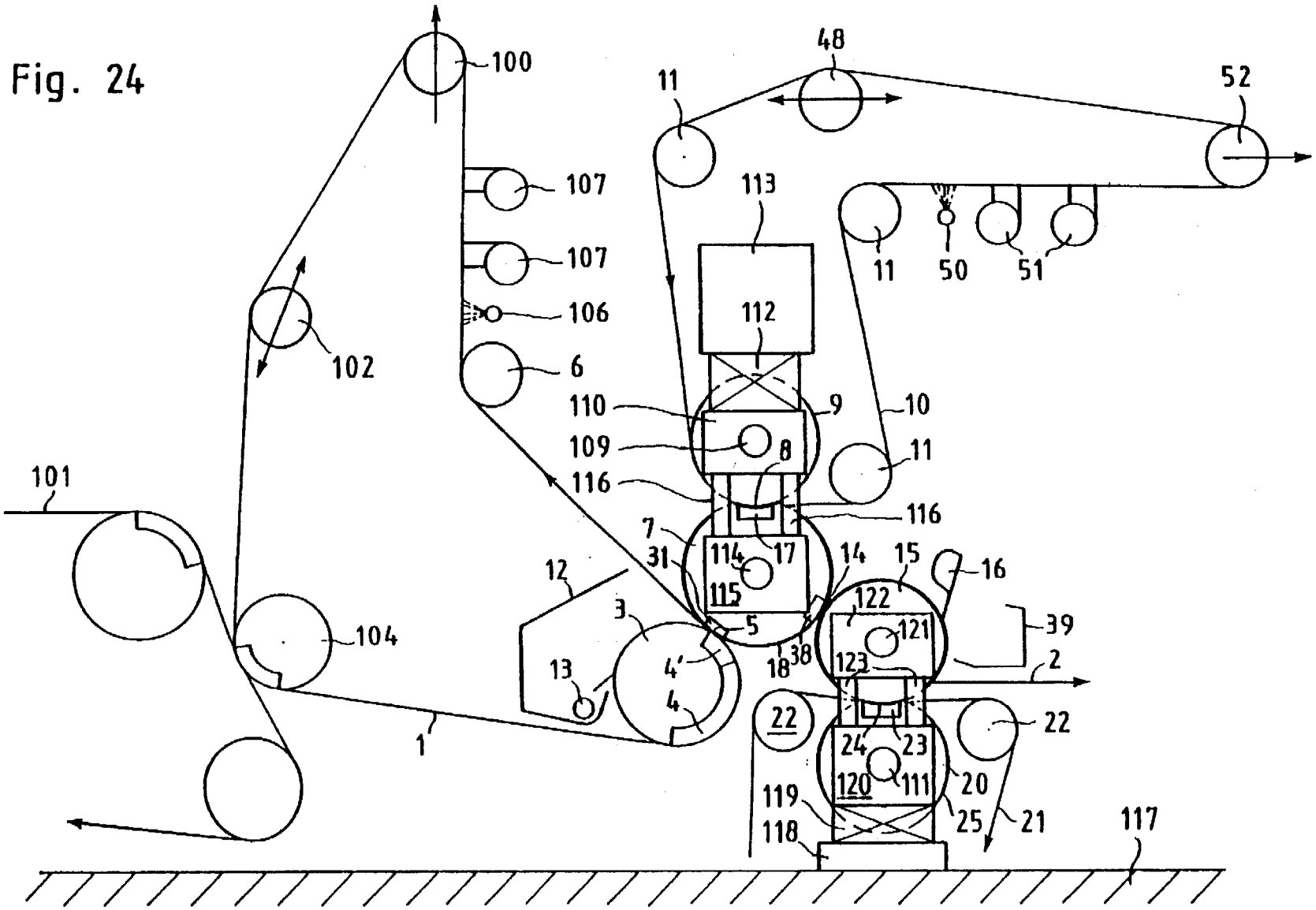
FIG. 24 shows an alternative wet-press arrangement with take-up felt and take-up suction roll.

In FIG. 24, as in FIG. 15, a paper web, hanging from a porous belt, passes to the suction roll 3 having suction zones 4 and 4' and is transferred in the first press nip 5 to the circumference of the shoe press roll 7. The belt 1 travels over guide, tensioning, and regulating rolls 6, 100 and 102 to a take-up suction roll 104, which draws the paper web 26 off from a web forming wire 101 onto the belt 1. Belt 1 is cleaned by spray pipe 106 and is acted on by slot suction boxes 107. Belt 1 can be a wire, i.e. a press wire, or a needle felt, or the like. Water pressed out in the press nip 5, by cooperation of the press rolls 3 with the radially movable ledge 31, is collected in the trough 12 and is discharged through the lateral outlet 13. After the press nip 5, the paper web 2 follows the surface of the roll 7 and is again pressed in the second press nip 8. The pressing force is applied on the one side by a lubricated press shoe 17 through a flexible press jacket 18 onto the one side of the paper web 2 and is applied on the other side from the press roll 9, which is held with its journals 109 in stands 110 via the press felt 10 on the other side of the paper web. The felt 10 travels over guide rolls 11 and over tensioning roll 52 and regulating roll 48 back to the press roll 9. The paper web 2 travels around on the smooth surface of the press jacket 18 of the roll 7 through a third press nip 14 over another radially movable ledge 38. From there, the web travels with the smooth surface of the normal tubular roll 15, through a fourth press nip 24 which is formed between the press rolls 15 and 20. The web 2 is detached from the surface of the roll 15 and is fed to the following treatment units. A scraper 16 with a receiving groove 39 cleans the surface of the roll 15.

Pressing of the paper web against the roll 15 is effected by the shoe press roll 20, and particularly by a radially movable press shoe 23 via the flexible press jacket 25 and the press felt 21, which is conducted over guide rolls 22. The press shoe 23 is supported on a stationary support member of which a journal 111 is visible. The bearing pedestals 110 which carry the two journals 109 of the press roll 9 are connected via intermediate pieces 112 with a stationary transverse beam 113, which is part of a press frame (not shown for reasons of clarity of the drawing). The bearing pedestals 115 which support the journals 114 of the stationary support member of the roll 7 are connected by tie rods 116 to the bearing brackets 110. Upon the change of a felt, roll or jacket, the tie rods 116 can be removed or broken down in their length.

A similar arrangement is present also in connection with the pair of rolls 15, 20. Base plates 118 rest on foundation plates or machine understructures 117 and intermediate pieces 119 rest on the base plates. Bearing brackets 120 in which the aforementioned journals of the roll 20 are supported rest on the pieces 119. The journals 121 of the roll 15 are supported in bearing brackets 122. The latter, in turn, are connected by removable tie rods 123 to the bearing brackets 120.

Again, due to the movable ledge 38, it is possible for each of the two roll pairs 7, 9 and 15, 20 to be supported in stationary bearing brackets 110, 115 and 120, 122. As a result, a movable roll mounting, similar to that of FIG. 20, is superfluous. The final result is that an extremely compact press section is obtained, with two felted water removal press nips of high capacity, including the second press nip 8 for the removal of water from one side of the web and the fourth press nip 24 for the removal of water from the other side of the web. Between these two nips, there is the feltless third press nip 14 for smoothing and turning the web. If necessary, the smooth tubular roll 15 can form a final press nip with an additional smooth tubular roll (not shown) for again smoothing the web in order to obtain the highest quality web.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of removing water from a fiber web in a wet press section of a paper making machine having first, second, and third press rolls, the first press roll having a smooth outer surface and forming a first press nip between the first press roll and a wire belt, the second press roll forming an extended, felted press nip with the first press roll, and the third press roll having a smooth outer surface and forming a third press with the first press roll, at least one of the press rolls being a shoe press roll having a flexible press jacket with an outer smooth jacket surface, the method comprising the steps of:

carrying the fiber web on the wire belt in a machine direction from a forming section of the paper making machine;

passing the web through the first press nip between the wire belt and the first press roll;

contacting the fiber web directly with the smooth outer surface of the first press roll;

transferring the fiber web from the endless wire belt to the smooth outer surface of the first press roll by passing the web through a first press nip between the wire belt and the first press roll;

carrying the web on the surface of the first press roll through a felted second press nip defined between the first and a second press roll;

continuing carrying the web on the outer surface of the first press roll past the second press nip through a third press nip between the first press roll and a third press roll with a smooth outer surface;

transferring the web thereafter from the first press roll smooth outer surface to the third press roll smooth outer surface;

conducting the web further around the smooth outer surface of the third press roll;

the first press roll is the shoe press roll having the flexible press jacket with the outer smooth jacket surface and the web is conducted past the first press nip including that jacket while the web is in contact with the smooth outer jacket surface of the flexible press jacket; and conducting the web thereafter further through the paper making machine.

2. The method of claim 1, wherein the further conducting of the web through the machine comprises conducting the web on the smooth outer surface of the third press roll through a fourth felted press nip defined between the third press roll and a fourth press roll.

3. The method of claim 1, further comprising pressing the flexible press jacket by a radially displaceable ledge against the smooth outer surface of the third press roll for defining the third press nip.

4. A wet press arrangement for removing water from a fiber web in a paper making machine, comprising:

a wire belt in a forming section which conducts the web to the press arrangement;

a first press roll having a smooth outer surface and positioned to directly contact the web on the wire belt for removing the web from the wire belt at the contact; the first press roll having at least first, second and third press nips located around its outer surface, through which the web carried on the outer surface of the first press roll passes in sequence while the web adheres to the smooth outer surface of the first press roll;

the first press nip being defined between the first press roll and the wire belt where the web is removed from the wire belt;

a second press roll positioned to cooperate with the first press roll to define the second press nip; a press felt which passes through the second press nip in contact with the web; and means for guiding the press felt to separate from the first press roll and the web after passage of the web and the press felt through the second press nip;

a third press roll positioned to cooperate with the first press roll to define the third press nip; the third press roll having a smooth outer surface such that when the web passes through the third press nip, the web transfers from the first press roll to the third press roll for being carried on the outer surface of the third press roll;

said first press roll comprises a shoe press roll having a flexible press jacket with an outer smooth surface, a stationary support member about which the press jacket revolves, and a press shoe having a concavely curved slide surface displaceable radially relative to the support member for causing the slide surface to press the press jacket against the outer surface of the opposing one of the press rolls at the respective press nip defined by the press shoe in order to form there an extended press nip; and one of the press felts passing through the respective press nip defined by the press shoe on the press jacket;

the shoe press roll further including a ledge which is also displaceable radially relative to the support and the press jacket, and the ledge being positioned in opposition to the third press roll with a smooth outer surface such that displacement of the ledge presses the press jacket against the smooth third press roll at the third press nip to form a non-felted press nip.

5. The wet press arrangement of claim 4, wherein the third press roll comprises a shoe press roll having a flexible press jacket with an outer smooth surface, a stationary support member about which the press jacket revolves, and a press shoe having a concavely curved slide surface displaceable radially relative to the support member, with the shoe of the shoe press roll cooperating with another of the press rolls for defining one of the press nips which is away from the first press nip at the wire belt.

6. The wet press arrangement of claim 5, wherein;

the third press roll includes a ledge at a location in and around the press jacket and displaceable relative to the support member;

a fifth press roll positioned for cooperating with the third press roll at the ledge for defining a fifth press nip; the fifth press roll having a smooth outer surface; and the ledge of the third press roll being positioned for being displaceable relative to the support member for pressing the press jacket of the third press roll against the fifth press roll to define the fifth press nip.

7. The wet press arrangement of claim 6, wherein the fifth press roll comprises a tubular roll.

8. The wet press arrangement of claim 4, wherein the first press roll further includes a ledge which is disposed in the press jacket in opposition to the wire belt, and the ledge is displaceable relative to the support member for pressing the press jacket against the wire belt for defining the first press nip.

9. The wet press arrangement of claim 4, wherein the third press roll which forms the third press nip with the first press roll, has a tubular rotatable roll body.

10. The wet press arrangement of claim 9, wherein the third press roll smooth outer surface is formed from one of a plastic covering or a stone body.

11. The wet press arrangement of claim 4, further comprising a forth press roll positioned to cooperate with the third press roll for defining a fourth press nip.

12. The wet press arrangement of claim 11, further comprising means in one of the third and fourth press rolls defining the fourth press nip for defining the fourth press nip as an extended press nip which is lengthened in the direction of travel of the web.

13. The wet press arrangement of claim 11, further comprising an endless press felt for passing in the web travel direction through the fourth press nip in contact with the web.

14. The wet press arrangement of claim 11, further comprising a fifth press roll positioned for contacting the third press roll for defining a fifth press nip which is positioned past the fourth press nip in the path of the web around the third press roll, wherein the third and the fifth press rolls each has a smooth outer surface.

15. The wet press arrangement of claim 14, wherein the smooth outer surface of the fifth press roll is harder than the smooth outer surface of the third press roll for causing the web to be carried on and follow the surface of the fifth press roll after passing through the fifth press nip.

16. The wet press arrangement of claim 14, further comprising a moistening spray pipe positioned for delivering a moistening spray to the smooth outer surface of the fifth press roll before the outer surface moves into the fifth press nip.

17. The wet press arrangement of claim 4, wherein the outer surface of the third press roll is harder than the outer surface of the first press roll for causing the transfer of the web from the first press roll to the third press roll at the third press nip.

18. The wet press arrangement of claim 4, further comprising a cleaning device consisting of at least one of a spray pipe, brush roll, a stripper or a scraper is arranged on at least one of the press rolls having a smooth outer surface.

19. The wet press arrangement of claim 18, wherein the cleaning device further comprises means extending over the entire width of the machine for removing dirt or paper broke which has been removed from at least one of the press rolls.

20. A wet press arrangement of claim 4, wherein the shoe press roll has an additional press shoe located along the web path after the first mentioned press shoe and inside the tubular jacket of the first press roll;

an additional press roll disposed at and cooperating with the first press roll for defining an additional press nip, and the additional press shoe having a slide surface which is concavely shaped for defining an extended press nip with the additional press roll;

an additional felt passing through the additional press nip in contact with the web.

21. The wet press arrangement of claim 4, wherein the web is guided on the wire belt and on the first press roll so that the top side of the web is in contact with the first press roll.

22. The wet press arrangement of claim 4, wherein the web is guided on the wire belt and on the first press roll so that the bottom side of the web is in contact with the first press roll.

23. The wet press arrangement of claim 4 having at least two felts, wherein at least one of the press rolls located at one of the nips through which one of the felts passes has an outer surface with recesses therein capable of receiving water.

24. The wet press arrangement of claim 11, wherein the second and fourth press nips have respective press planes that are approximately parallel and are approximately vertical, while the path of the web through the wet press arrangement is generally horizontal.

25. The wet press arrangement of claim 4, wherein the ledge in the shoe press roll has a convexly curved slide surface for engaging the press jacket.

26. The wet press arrangement of claim 25, wherein the radius of curvature of the slide surface of the ledge is at most equal to the radius of the path of revolution of the press jacket past its slide surface.

27. A wet press arrangement for removing water from a fiber web in a paper making machine, comprising:

a wire belt in a forming section which conducts the web to the press arrangement;

a first press roll having a smooth outer surface, an extended nip, and positioned to directly contact the web on the wire belt for removing the web from the wire belt at the contact; the first press roll having at least first, second and third press nips located around its outer surface, through which the web carried on the outer surface of the first press roll passes in sequence while the web adheres to the smooth outer surface of the first press roll;

the first press nip being defined between the first press roll and the wire belt where the web is removed from the wire belt;

a second press roll positioned to cooperate with the first press roll to define the second press nip; a press felt which passes through the second press nip in contact with the web; and means for guiding the press felt to separate from the first press roll and the web after passage of the web and the press felt through the second press nip;

a third press roll positioned to cooperate with the first press roll to define the third press nip; the third press roll having a smooth outer surface such that when the web passes through the third press nip, the web transfers from the first press roll to the third press roll for being carried on the outer surface of the third press roll;

at least one of the smooth first and third press rolls comprises a shoe press roll having a flexible press jacket with an outer smooth surface, a stationary support member about which the press jacket revolves, and a press shoe having a concavely curved slide surface displaceable radially relative to the support member for causing the slide surface to press the press jacket against the outer surface of the opposing one of the press rolls at the respective press nip defined by the press shoe in order to form there an extended press nip; and one of the press felts passing through the respective press nip defined by the press shoe on the press jacket;

the shoe press roll further including a ledge which is also displaceable radially relative to the support and the press jacket, and the ledge being positioned in opposition to another of the press rolls which is a second one of the press rolls with a smooth outer surface such that displacement of the ledge presses the press jacket against the second smooth press roll at the respective press nip to form a non-felted press nip;

a fourth press roll positioned to cooperate with the third press roll for defining a fourth press nip, and a second felt passing through the fourth press nip in contact with the web;

a fifth press roll positioned for contacting the third press roll for defining a fifth press nip which is positioned past the fourth press nip in the path of the web around the third press roll, wherein the third and the fifth press rolls each has a smooth outer surface.

28. The wet press arrangement of claim 27, wherein the smooth outer surface of the fifth press roll is harder than the smooth outer surface of the third press roll for causing the web to be carried on and follow the surface of the fifth press roll after passing through the fifth press nip.

29. The wet press arrangement of claim 27, further comprising a moistening spray pipe positioned for delivering a moistening spray to the smooth outer surface of the fifth press roll before the outer surface moves into the fifth press nip.

* * * * *